United States Patent [19]

Watanabe et al.

[11] Patent Number: 4,754,188

[45] Date of Patent: Jun. 28, 1988

[54] COLOR PICTURE TUBE SHADOW MASK MATERIAL

[75] Inventors: Rikizo Watanabe, Yasuki; Akira Misumi; Ryoji Hirai, both of Mobara, all of Japan

[73] Assignees: Hitachi, Ltd.; Hitachi Metals, Ltd., both of Tokyo, Japan

[21] Appl. No.: 853,626

[22] Filed: Apr. 18, 1986

[30] Foreign Application Priority Data

Apr. 26, 1985 [JP] Japan ..... 60-90346

[51] Int. Cl.[4] ..... H01J 29/07

[52] U.S. Cl. ..... 313/402

[58] Field of Search ..... 313/402, 407, 408; 445/36, 47; 252/513, 519

[56] References Cited

PUBLICATIONS

Japanese Patent Laid-open Specification No. sho 50-58977.

Japanese Utility Model Publication No. sho 55-52610.

*Primary Examiner*—David K. Moore

*Assistant Examiner*—Sandra L. O'Shea

*Attorney, Agent, or Firm*—Charles E. Pfund

[57] ABSTRACT

A color picture tube shadow mask material is made of an alloy consisting of 30 to 45 wt. % of Ni, 0.1 to 5.0 wt. % of V, and the balance essentially Fe. A color picture tube having a shadow mask consisting of this material is also prepared. The alloy has an average thermal expansion coefficient of $6\times10^{-6}$/°C. or less in a temperature range of 20 to 100° C., and an elasticity coefficient of 15,000 kgf/mm$^2$ or more.

4 Claims, 3 Drawing Sheets

COLOR PICTURE TUBE SHADOW MASK MATERIAL

BACKGROUND OF THE INVENTION

The present invention relates to a material for a color picture tube shadow mask and a color picture tube using the same.

A conventional color picture tube shadow mask has a large number of regularly aligned apertures. The number of electrons passing through the apertures is about ⅓ or less the total number of electrons. The remaining electrons bombard and heat the shadow mask, resulting in thermal expansion of the shadow mask and degradation of color purity.

In a conventional color picture tube with a shadow mask, beam mislanding caused by thermal expansion must be limited. For this reason, improvements in the shadow mask structure itself, the assembly of the shadow mask and its support, and the shadow mask material have all been explored. However, no substantial solutions have been found so far.

Mild steel is normally used as a shadow mask material. Although mild steel has good press formability, its thermal expansion coefficient is as high as $12\times10^{-6}/°$ C. Thus thermal deformation occurs upon electron beam irradiation, and color purity is degraded In order to prevent thermal deformation, an Fe-Ni invar alloy shadow mask with a small thermal expansion coefficient has been proposed Since this alloy has a high yield stress, however, it provides poor press formability. In addition, since the invar alloy has a low elasticity coefficient, deformation of the shadow mask can occur during fabrication, assembly of a color picture tube, and operation of the color picture tube, thus degrading color purity. Recently, various types of shadow mask materials have been proposed in, among others, Japanese Patent Prepublication Nos. 50-58977 and 59-59861. These materials are prepared by adding alloy elements to an Fe-Ni invar alloy. However, they cannot completely overcome the conventional shortcomings.

SUMMARY OF THE INVENTION

It is, therefore, a principal object of the present invention to provide a color picture tube shadow mask material and a color picture tube using the same, wherein the thermal expansion and elasticity coefficients of the material are smaller than those of a conventional mild steel material, and a yield stress is smaller and press formability is better than those of a conventional Fe-Ni invar alloy.

It is another object of the present invention to provide a color picture tube using a shadow mask substantially free from degradation of color purity.

According to the present invention, the average thermal expansion coefficient in the temperature range of 20° C. to 100° C. is $6\times10^{-6}/°$ C. or less, and preferably $4\times10^{-6}/°$ C. or less, the 0.2% yield stress is 20 kgf/mm$^2$ or less and preferably 18 kgf/mm$^2$ or less, and the elasticity coefficient is 15,000 kgf/mm$^2$ or more.

In order to achieve the above objects of the present invention, there is provided a shadow mask material consisting of 30 to 45 wt % of Ni, 0.2 to 5.0 wt % of V, and the balance essentially consisting of Fe excluding inevitable impurities. 5 wt % or less of at least one of Cr, Mo and W can be added to the above composition.

A combination of Ni and Fe provides the so-called invar effect, which reduces the thermal expansion coefficient near room temperature. This effect is obtained within a specific Ni content range. When the Ni content is less than 30 wt % or exceeds 45 wt %, the invar effect cannot be obtained. The Ni content range is thus determined to be 30 wt % to 45 wt %, and preferably 35 wt % to 40 wt %.

V in the shadow mask material reduces the yield stress to improve press formability and increase the elasticity coefficient. In order to obtain such effects, the content of V must be at least 0.1 wt %. However, when the V content exceeds 5 wt % the thermal expansion coefficient is undesirably increased. Therefore, the V content range is given as 0.1 wt % to 5.0 wt %.

Other additives Cr, Mo and W have the same effects (i.e., a reduction in yield stress and an increase in the elasticity coefficient), but are less effective than V. In particular, Cr has the auxiliary effect of improving adhesion of an oxide film when the shadow mask is blackened. Therefore, a small amount of Cr is preferably added to the shadow mask material, as desired. However, the Cr content exceeds 5 wt %, the thermal expansion coefficient of the resultant material is undesirably increased. Therefore, the content of Cr, Mo or W in the color picture tube shadow mask material of the present invention is set at 5 wt % or less.

C, Si, Mn, Al, Ti, Mg, Ca or the like may be added to the color picture tube shadow mask material of the present invention to perform deoxidation or desulfurization. Allowable residual contents (wt %) of these elements in the alloy are given as follows:

C<0.2 wt %
Si<0.5 wt %
Mn<1.0 wt %
Al<0.5 wt %
Ti<0.5 wt %
Mg<0.1 wt %
Ca<0.1 wt %

According to an aspect of the present invention, there is provided a color picture tube comprising a shadow mask of an alloy consisting of 30 to 45 wt % of Ni, 0.1 to 5.0 wt % of V, and the balance essentially consisting of Fe.

DESCRIPTION OF THE PREFERRED EMBODIMENTS

Figure 1:
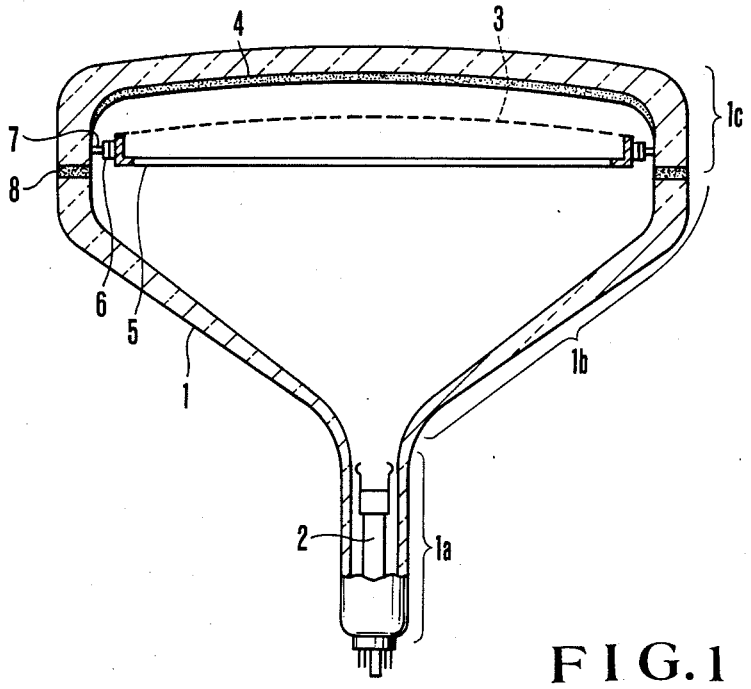
FIGS. 1 to 6 are schematic views showing color picture tubes employing the present invention.

Preferred embodiments of the present invention will now be described. Alloys shown in Table 1 were vacuum-melted, forged, hot-rolled and cold-rolled to obtain plates each having a thickness of 0.2 mm. These plates were annealed at a temperature of 1,000° C. for one hour. The average thermal expansion coefficient in the temperature range of 20° C. to 100° C., 0.2% yield stress and the elasticity coefficient were measured for each of these plates. The elasticity coefficients were measured using a resonance method. The properties of these plates are also summarized in Table 1 below.

TABLE 1

| Alloy | Sample | Composition (%) Ni | V | Others | Fe | Average Thermal Expansion Coefficient ($10^{-6}$/°C.) | 0.2% Yield Stress (kgf/mm$^2$) | Elasticity coefficient (kgf/mm$^2$) |
|---|---|---|---|---|---|---|---|---|
| Present | 1 | 36.5 | 1.1 | — | Bal | 1.78 | 20.0 | 15,200 |
| Invention | 2 | 36.7 | 2.0 | — | Bal | 2.53 | 17.9 | 16,200 |
| | 3 | 36.4 | 2.9 | — | Bal | 3.28 | 15.8 | 17,200 |
| | 4 | 36.5 | 4.0 | — | Bal | 4.19 | 13.3 | 18,400 |
| | 5 | 36.6 | 3.0 | Cr 1.1 | Bal | 4.10 | 13.7 | 17,900 |
| | 6 | 36.4 | 2.1 | Cr 1.9 | Bal | 3.89 | 14.4 | 17,300 |
| | 7 | 36.5 | 1.1 | Cr 2.9 | Bal | 3.73 | 15.0 | 16,700 |
| | 8 | 36.6 | 0.6 | Cr 2.1 | Bal | 2.69 | 17.3 | 15,600 |
| | 9 | 36.7 | 1.0 | Cr 2.0 | Bal | 2.92 | 18.4 | 15,300 |
| | 10 | 36.7 | 2.0 | Mo 2.0 | Bal | 4.03 | 15.3 | 17,000 |
| | 11 | 36.6 | 2.1 | W 1.9 | Bal | 3.28 | 16.1 | 17,500 |
| Comparative | 12 | 41.0 | — | Al 1.2 | Bal | 3.64 | 24.0 | 13,800 |
| | 13 | 39.9 | — | Nb 4.0 | Bal | 3.37 | 34.7 | 15,800 |
| | 14 | 40.8 | — | Ti 2.4 | Bal | 3.28 | 29.2 | 15,000 |
| | 15 | 36.4 | — | Cr 2.0 | Bal | 3.06 | 18.4 | 14,900 |
| | 16 | 36.5 | — | Mo 2.0 | Bal | 2.57 | 19.9 | 14,800 |
| | 17 | 36.7 | — | W 2.0 | Bal | 2.54 | 20.9 | 15,200 |
| Prior | 18 | 36.5 | — | — | Bal | 0.87 | 22.5 | 14,000 |
| Art | 19 | Mild steel | | | | 12.0 | 11.4 | 21,000 |

Alloys of the present invention represented by samples 1 to 11 in Table 1 have average thermal expansion coefficients of $6\times10^{-6}$/° C. or less, 0.2% yield stresses of 20 kgf/mm$^2$ or less, and elasticity coefficients of 15,000 kgf/mm$^2$ or more. However, comparative alloys represented by samples 12 to 17, sample 18 (invar alloy) and sample 19 (mild steel) fail to satisfy at least one of the above standards. Cr, Mo, and W as well as V have properties for decreasing the yield stress, whereas Al, Nb, and Ti do not. However, Cr, Mo, and W are less effective in reducing yield stress and increasing elasticity coefficient than V. Although measured values of the elasticity coefficients differ depending on the measuring method, the elasticity coefficients of the alloys in samples 1 to 11 are higher than that of sample 18 (invar alloy).

Addition of a third element to an invar alloy naturally increases the elasticity coefficient, since a third element weakens the invar effect. However, the reason why addition of V, Cr, Mo, and W to the alloy reduces the yield stress is unknown at present. Since all of these elements are known as elements for increasing yield stress in an austenite alloy by solid solution strengthening, their ability to reduce yield stress seems to be a special phenomenon limited to invar alloys.

Embodiments of the color picture tubes according to the present invention will be described below.

Figure 2:
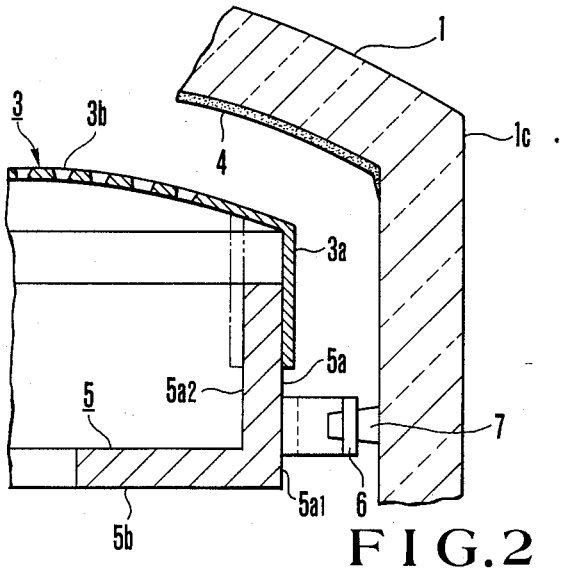
Figure 3:
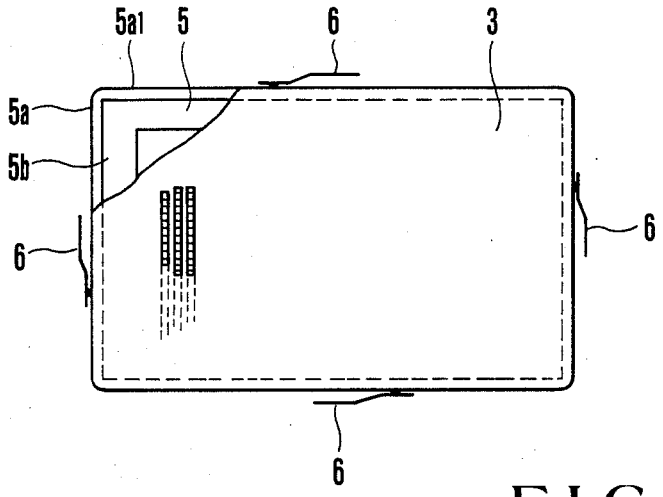

FIG. 1 shows a color picture tube according to an embodiment of the present invention. Referring to FIG. 1, reference numeral 1 denotes a bulb; 2, an electron gun; and 3, a tray-like shadow mask. The shadow mask 3 consists of an improved invar alloy of a composition (to be described later) according to the present invention. Reference numeral 4 denotes a phosphor screen; 5, a mask support for supporting the shadow mask 3; 6, a plurality of support members mounted on the outer surface of the mask support 5; and 7, a panel pin extending from the bulb 1. A free end of the support 6 is engaged with the corresponding panel pin 7. FIGS. 2 and 3 show the detailed structure of the shadow mask 3 and its peripheral structure. Referring to FIGS. 2 and 3, a skirt 3*a* of the shadow mask 3 is fixed by welding or the like to an outer side surface 5*a*1 of a vertical wall 5*a* of the mask support 5. One end of the support member 6 is fixed to the outer side surface 5*a*1, and the free end of the member 6 is engaged with the corresponding panel pin 7. Reference numeral 3*b* denotes mask apertures. The shadow mask 3 may be fixed on an inner surface 5*a*2 of the mask support 5, as indicated by the alternate long and short dashed line. Reference numeral 5*b* denotes a flange for the mask support 5 which is bent inward toward the tube axis (not shown).

Figure 4:
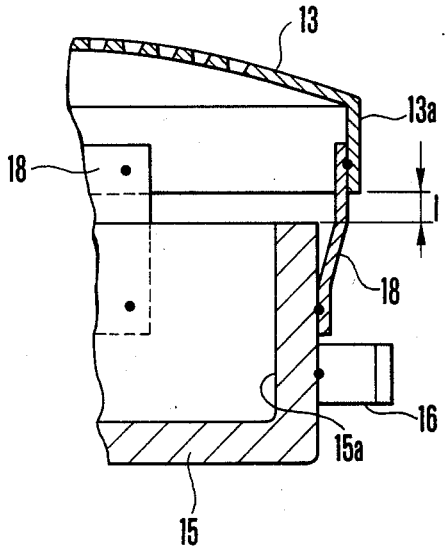
Figure 6:
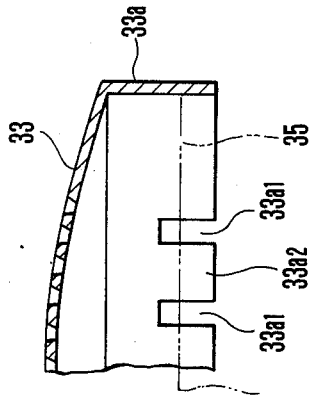

FIG. 4 shows another embodiment of a color picture tube employing the present invention. In this embodiment, the color picture tube has a shadow mask 13 consisting of an improved invar alloy, just as the embodiment in FIG. 1. The shadow mask 13 is not directly fixed to a vertical wall 15*a* of a mask support 15 but instead is vertically spaced apart therefrom by a distance l. The shadow mask 13 is connected to the vertical wall 15*a* through an intermediate member 18. With this connection method, deformation of the shadow mask 13 by the mask support 15 can be prevented even if the mask support 15 and the shadow mask 13 consist of materials with different thermal expansion coefficients.

With this arrangement, even if the shadow mask and the mask support are made of the same material, mask deformation can be prevented. Furthermore, as described in Japanese Utility Model Publication No. 55-52610, a mechanical strength adjusting means may be provided in the region extending from the skirt of the shadow mask to a peripheral flat portion around the recessed surface portions.

The present invention will be described in detail by way of its example. EXAMPLE 1

Figure 5:
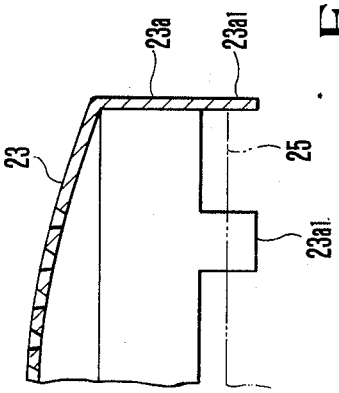

0.15 mm thick plates of the alloys in samples 1, 2, 4, 5, and 8 to 11 were used. Shadow mask plates with 0.095 mm wide slots at pitches of 0.40 mm were prepared by etching. The shadow mask plates were annealed in a gas mixture of nitrogen and hydrogen at a temperature of 1,000° C. for one hour, thereby obtaining slotted shadow mask plates. These shadow mask plates were pressed to prepare 24 pieces of 15" shadow masks (three masks per plate). These shadow masks were blackened at a temperature of 600° C. for half an hour and then combined with 1.6 mm thick mild steel mask supports to prepare shadow mask assemblies like the one shown in FIG. 5. Each shadow mask had two projections 23*a*1 on each of the long and short sides. The projections on the short side had a width of 14 mm and a length of 5.5 mm, and the projections on the long side had a width of 18 mm and a length of 5.5 mm. The projections were located 350 mm away from the center of each side.

Color picture tubes were prepared by a known method using the shadow mask assemblies formed by the above process and were fixed in wooden boxes with the outer surfaces of the panels facing upward. The boxes were dropped from a height of 30 cm to check the mechanical strength of the shadow masks. The color picture tubes in Example 1 were compared with the prior art color picture tubes listed below. No deformation occurred in the picture tubes of Example 1.

| Specification | Shadow Mask | Mask Support | Assembly Structure |
|---|---|---|---|
| 1 | 0.18 mm thick plate (sample 19) | 1.6 mm thick mild steel material | FIG. 1 |
| 2 | 0.15 mm thick plate (sample 18) | 1.6 mm thick mild steel material | FIG. 1 |

In the shadow mask using the conventional invar material of specification 2, wrinkle-like permanent deformations were left, causing a large defect on the screen of the resultant color picture tube. This picture tube could not be used in practice. Deformation of the shadow mask using the mild steel of specification 1 was virtually the same as that of Example 1. However, electrical characteristics of the shadow mask of specification 1 were degraded since beam mislanding did not fall within the allowable range due to doming. Beam mislanding in the shadow masks of Example 1 fell within the allowable range.

Figure 7:
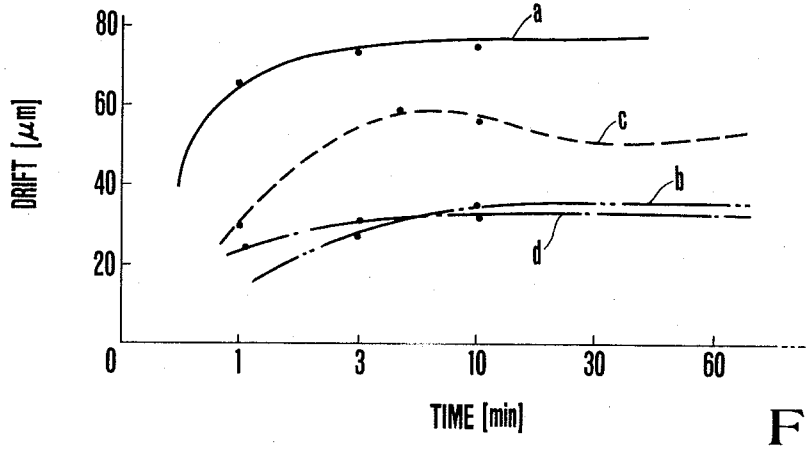

FIG. 7 is a graph showing doming characteristics (i.e., drift of the center of a shadow mask as a function of time) for shadow masks of the present invention and conventional shadow masks. A characteristic curve a represents the drift for the shadow mask of the mild steel material of specification 1. A characteristic curve b represents the drift for the shadow mask of the conventional invar alloy. A characteristic curve c represents the drift for the shadow mask consisting of 36.5 wt % of Ni and 2.0 wt % of Cr but no V. A characteristic curve d represents the drift for the shadow mask consisting of 36.4 wt % of Ni, 2.0 wt % of Cr, and 1.0 wt % of V. The shadow mask of the present invention has good doming characteristics. In other words, as compared with the shadow mask of the conventional mild steel material its drift as a function of time can be decreased. In addition, it has a smaller yield stress than that of the conventional Fe-Ni invar alloy shadow mask and can thus be easily pressed. As is apparent from the characteristic curve c, the shadow mask consisting of no V has a large drift and cannot be used in practice.

The color picture tubes having shadow masks with alloy compositions of the present invention could be pressed in the same manner as the conventional mild steel shadow mask. In addition, the strength of the resultant shadow masks of the present invention was higher than the conventional invar shadow mask. Since the shadow mask of the present invention has an average thermal expansion coefficient (in the temperature range of 20° C. to 100° C.) of about $\frac{1}{3}$ or less that of mild steel, beam mislanding caused by doming can be reduced to $\frac{1}{2}$ or less that of the conventional mild steel shadow mask. When the thermal expansion coefficient exceeds $6\times10^{-6}/°$ C., beam mislanding cannot fall within the allowable range.

In Example 1, the shadow mask and the mask support are made of different metals. However, when these members are made of the same invar alloy, thermal deformation can be further reduced, and further improvements in color purity can be expected. For example, the mask support may comprise a thin plate, as described in Japanese Patent Publication No. 59-13824.

As is apparent from the above description, the shadow mask material of the present invention provides a picture tube shadow mask material and a color picture tube using this material, which satisfy the following three conditions: (1) the yield stress is sufficiently small so that pressing can be easily performed; (2) the thermal expansion coefficient is small, so that a color picture tube prepared using this shadow mask is free from color misregistration; and (3) the elastic coefficient is high, so that the shadow mask is free from deformation during fabrication and operation of the picture tube. Therefore, the present invention can be effectively applied to the fabrication of high-resolution picture tubes.

What is claimed is:

1. A color picture tube shadow mask material comprising an alloy including 30 to 45 wt % of Ni, 0.1 to 5.0 wt % of V, and the balance essentially Fe.

2. A material according to claim 1, wherein the alloy further includes 35 to 40 wt % of Ni, 0.1 to 5.0 wt % of V, and at least one member selected from the group consisting of not more than 5.0 wt % of Cr, not more than 5.0 wt % of Mo, and not more than 5.0 wt % of W.

3. A material according to claim 2, wherein the alloy further includes 35 to 40 wt % of Ni, 0.1 to 3.0 wt % of V, and 1.0 to 3.0 wt % of Cr.

4. A material according to claim 1, wherein the alloy has an average thermal expansion coefficient of not more than $6\times10^{-6}/°$ C. in a temperature range of 20 to 100° C., and an elasticity coefficient of not less than 15,000 kgf/mm$^2$.

* * * * *